US010383500B2

(12) United States Patent
Magnani et al.

(10) Patent No.: US 10,383,500 B2
(45) Date of Patent: Aug. 20, 2019

(54) DUAL-BLADED SCRAPER WITH A ROTATABLE BLADE-RETAINING HEAD

(71) Applicant: Hyde Tools, Inc., Southbridge, MA (US)

(72) Inventors: Mario E. Magnani, Springfield, MA (US); Richard M. Farland, Fiskdale, MA (US); Corey Talbot, Hebron, CT (US)

(73) Assignee: Mario E. Magnani, Springfield, MA (US)

( * ) Notice: Subject to any disclaimer, the term of this patent is extended or adjusted under 35 U.S.C. 154(b) by 0 days.

(21) Appl. No.: 14/826,494

(22) Filed: Aug. 14, 2015

(65) Prior Publication Data

US 2016/0066761 A1 Mar. 10, 2016

Related U.S. Application Data

(60) Provisional application No. 62/046,983, filed on Sep. 7, 2014.

(51) Int. Cl.
*B26B 3/00* (2006.01)
*A47L 13/08* (2006.01)
(Continued)

(52) U.S. Cl.
CPC ..... *A47L 13/08* (2013.01); *A47L 13/022* (2013.01); *B26B 5/005* (2013.01); *B44D 3/164* (2013.01)

(58) Field of Classification Search
CPC ..... A47L 13/022; A47L 13/08; B26B 5/005; B44D 3/164
(Continued)

(56) References Cited

U.S. PATENT DOCUMENTS 1,266,921 A * 5/1918 Cremers ..... A01B 1/06 172/372
1,860,454 A 5/1932 Dessel
(Continued)

OTHER PUBLICATIONS

Brasscity Records Toolworks Website: http://www.brasscityrecords.com/toolworks/feature/scrapers/hand . . . .
(Continued)

*Primary Examiner* — Ghassem Alie
*Assistant Examiner* — Bharat C Patel
(74) *Attorney, Agent, or Firm* — Louis J. Franco; Law Office of Louis J. Franco

(57) ABSTRACT

A dual-bladed scraper includes a handle extending between a proximal end including a grip portion and a distal end extending forwardly of the proximal end. A blade-retaining head is rotatably mounted to the distal end for pivotal movement about a head-rotation axis. The head has opposed first and second ends configured for retaining, respectively, first and second scraping blades on mutually opposite sides of the head-rotation axis about which the head is pivotable between first and second angular positions. The first angular position is such that the first blade is in a deployed attitude and the second blade is shrouded in a non-deployed attitude beneath the handle. Conversely, the second angular position is such that the second blade is in a deployed attitude and the first blade is shrouded in a non-deployed attitude beneath the handle.

15 Claims, 4 Drawing Sheets

(51) Int. Cl.
*B26B 5/00* (2006.01)
*B44D 3/16* (2006.01)
*A47L 13/022* (2006.01)

(58) Field of Classification Search
USPC ..... 30/172, 346.55, 346.56, 346.6, 346.61, 30/335, 51, 526
See application file for complete search history.

(56) References Cited

U.S. PATENT DOCUMENTS 2,286,190 A * 6/1942 Abrahamsen ..... B08B 1/00 30/171
3,162,947 A * 12/1964 Gringer ..... A47L 13/08 30/171
3,250,000 A * 5/1966 Schumann ..... A47L 13/08 15/236.05
3,363,316 A 1/1968 Rasmussen
3,895,439 A * 7/1975 Ehrenberg ..... B23B 51/101 15/236.05
4,305,175 A 12/1981 Burgess
4,481,689 A 11/1984 Westmoreland
4,574,417 A * 3/1986 Magnasco ..... A47L 13/08 15/236.05
4,984,324 A 1/1991 Farris
5,467,498 A * 11/1995 Keegan ..... A47L 13/08 15/236.01
5,471,698 A 12/1995 Francis
5,491,896 A * 2/1996 Stolzer ..... B24B 23/04 15/236.01
6,629,330 B2 * 10/2003 Schultheis ..... A47J 43/288 134/6
6,629,331 B2 * 10/2003 Panfili ..... A47L 13/08 15/143.1
7,103,936 B1 9/2006 Brandon
7,150,102 B2 * 12/2006 Gringer ..... B44D 3/164 30/171
7,415,769 B2 * 8/2008 Hughes ..... A47J 17/02 15/111
7,437,794 B2 * 10/2008 Massaro ..... A47L 13/08 15/236.01
7,913,349 B2 3/2011 Byrnes
8,307,490 B2 11/2012 Gringer
2002/0095737 A1 7/2002 Panfili et al.
2007/0271796 A1 * 11/2007 Oikarinen ..... A47L 13/08 30/169
2009/0241990 A1 10/2009 Smith

OTHER PUBLICATIONS

Harbor Freight 2 1/2 0 inch pain scraper with 4-sided blade Website: http://www.harborfreight.com/2-1-2-half-inch-paint-scraper-with-4-sided-blade-99827.html.

* cited by examiner

DUAL-BLADED SCRAPER WITH A ROTATABLE BLADE-RETAINING HEAD

PROVISIONAL PRIORITY CLAIM

Priority based on Provisional Application, Ser. No. 62/046,983 filed Sep. 7, 2014, and entitled "DUAL-BLADED SCRAPER WITH ROTATABLE BLADE-RETAINING HEAD" is claimed. Moreover, the entirety of the previous provisional application, including the drawings, is incorporated herein by reference as if set forth fully in the present application.

BACKGROUND

Scrapers for removing old paint, rust and other debris from a surface to be refinished are well known and have been the subject of numerous innovations. Differently designed scrapers are used for different purposes. For example, many carbide-blade scrapers have a dedicated handle designed to removably retain a single blade type. More specifically, one type is designed to retain a 2½" wide carbide blade to scraper large planar surfaces, while another is designed to retain a 1" triangular blade to reach into corners and other tight spaces. For the most part, painters and other surface refinishers are required to own and carry multiple scrapers each of which is designed for a specific purpose. Not only must a surface finisher carry multiple scraping tools, he/she is required to put one down and pick up another when scraping different types of surfaces related to the same project. This might require an inconvenient, and potentially dangerous, change of tools while up on a ladder, etc.

Accordingly, a need exists for a single scraper capable of allowing a user to conveniently and quickly change from one active blade type to another.

SUMMARY

In each of various alternative embodiments, a dual-bladed scraper with a rotatable blade-retaining head includes an elongated handle having handle upper and lower surfaces extending along a longitudinal handle axis between longitudinally opposed proximal and distal handle ends. The proximal end includes a grip portion configured for gripping by a first hand of a user, while the distal end extends forwardly of the proximal end and the grip portion. Additionally, some versions include a knob configured for gripping by a second hand of a user; that is, the hand not being used to grasp the grip portion of the proximal end. An optimal location for the knob is suggested in association with specification illustrative embodiments discussed in the detailed description, but it is sufficient to observe presently that situating the knob in proximity to the distal end of the handle is often most advantageous.

The blade-retaining head is rotatably mounted to the distal end of the handle for pivotal movement, relative to the handle, about a head-rotation axis. The blade-retaining head has opposed first and second ends mutually situated on opposite sides of the head-rotation axis. The first and second ends of the blade-retaining head define, respectively, first-blade and second-blade mounts configured to removably retain, simultaneously and respectively, a first scraping blade with at least one first-blade scraping edge and a separate, second scraping blade with at least one second-blade scraping edge.

The blade-retaining head is pivotable about the head-rotation axis between first and second angular positions. When first and second scraping blades are mounted on respective first-blade and second-blade mounts, the first angular position is such that the first scraping blade is in a deployed attitude in which a first-blade scraping edge thereof can engage a work surface to be scraped while the second scraping blade is in a non-deployed attitude in which the at least one second-blade scraping edge is at least partially shrouded beneath the handle lower surface. Analogously, but conversely, the second angular position is such that the second scraping blade is in a deployed attitude in which a second-blade scraping edge thereof can engage a work surface to be scraped while the first scraping blade is in a non-deployed attitude in which the at least one first-blade scraping edge is at least partially shrouded beneath the handle lower surface. Although movement between the first and second angular positions is typically achieved by a 180-degree rotation of the blade-retaining head, embodiments wherein this change between positions is achieved by less than a 180-degree rotation are within the scope and contemplation of the invention. According to at least one embodiment, at least a portion of the distal end of the handle is laterally flared relative to the grip portion in order to define a blade shroud configured such that, when each of first and second scraping blades retained by, respectively, the first and second ends is alternatively in the non-deployed attitude, the at least one scraping edge of that non-deployed blade is entirely shrouded by the blade shroud as viewed from above the handle upper surface.

In each of several variants, the first-blade and second-blade mounts include, respectively, first and second blade-supporting surfaces that define, respectively, first and second blade planes that are mutually non-coplanar and non-parallel. In at least one such version, the first and second blade planes are pitched such that they mutually diverge downwardly away from the distal end of both the handle and the head rotation axis. In versions of the latter type, the blade-retaining head may be of generally arcuate configuration in order to facilitate and compliment the divergent blade pitch. More specifically, the underside of the blade-retaining head (i.e., side closest a work surface being scraped) is concave while the upper side of the head is convex.

Representative embodiments are more completely described and depicted in the following detailed description and the accompanying drawings.

DETAILED DESCRIPTION

The following description of variously embodied dual-bladed scrapers is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to define the maximum scope of the claims.

Figure 1:
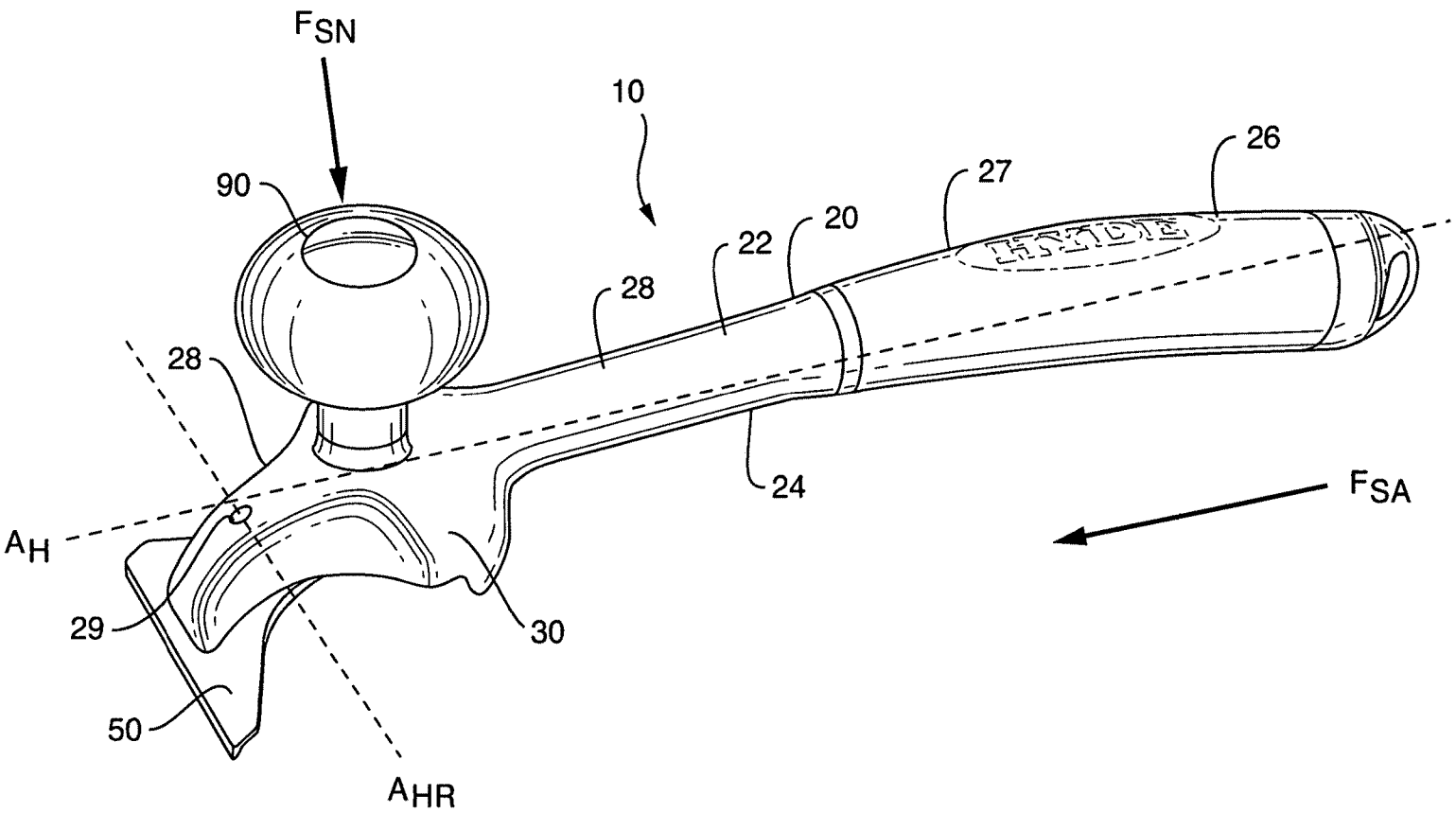
FIG. 1 is an upper left side perspective view of an illustrative dual-bladed scraper having a handle and a blade-retaining head that is rotatable between first and second angular positions relative to the handle wherein the head is in the first angular position.

Referring initially to the left-side perspective view of FIG. 1, an illustrative dual-bladed scraper 10 includes an elongated handle 20 with handle upper and lower surfaces 22 and 24 that extend along a handle axis $A_H$ between longitudinally opposed proximal and distal ends 26 and 28. The proximal end 26 includes a grip portion 27 configured for gripping by a first hand of a user (hand not shown), while the distal end 28 extends forwardly of the proximal end 26 and the grip portion 27.

Figure 2:
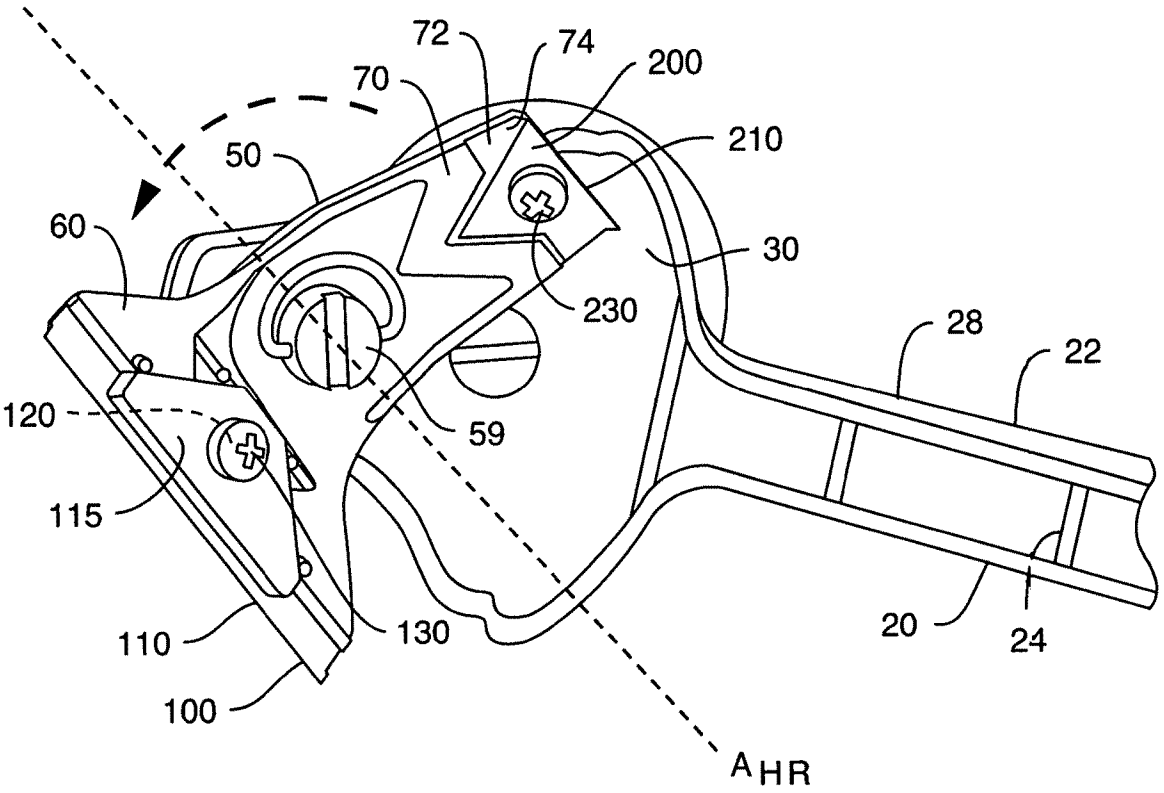
FIG. 2 is a lower left side perspective view of the scraper in FIG. 1 wherein the blade-retaining head is in a transitional angular position between the first and second angular positions.
Figure 3:
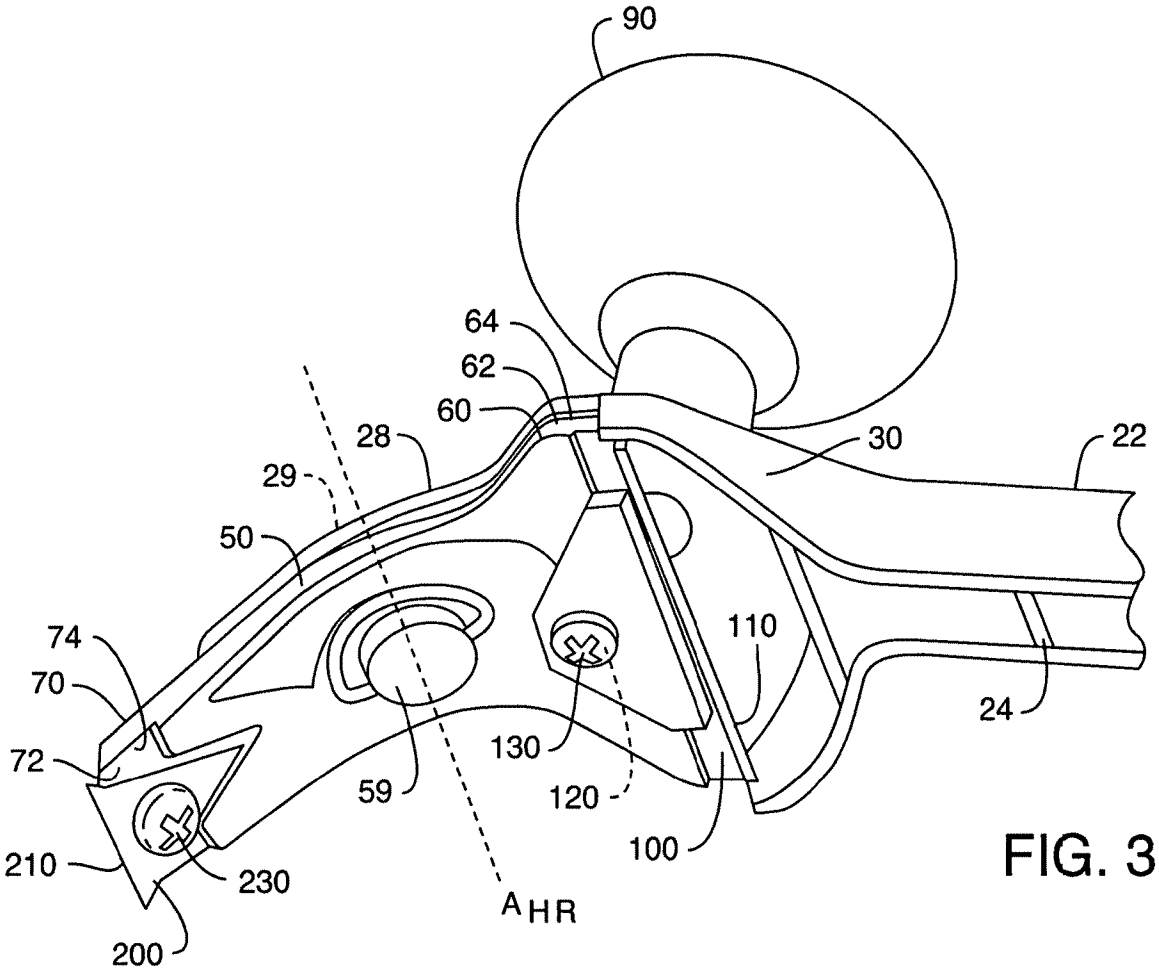
FIG. 3 depicts a lower left side perspective view of the scraper of FIGS. 1 and 2 in which the blade-retaining head is in the second angular position.
Figure 4:
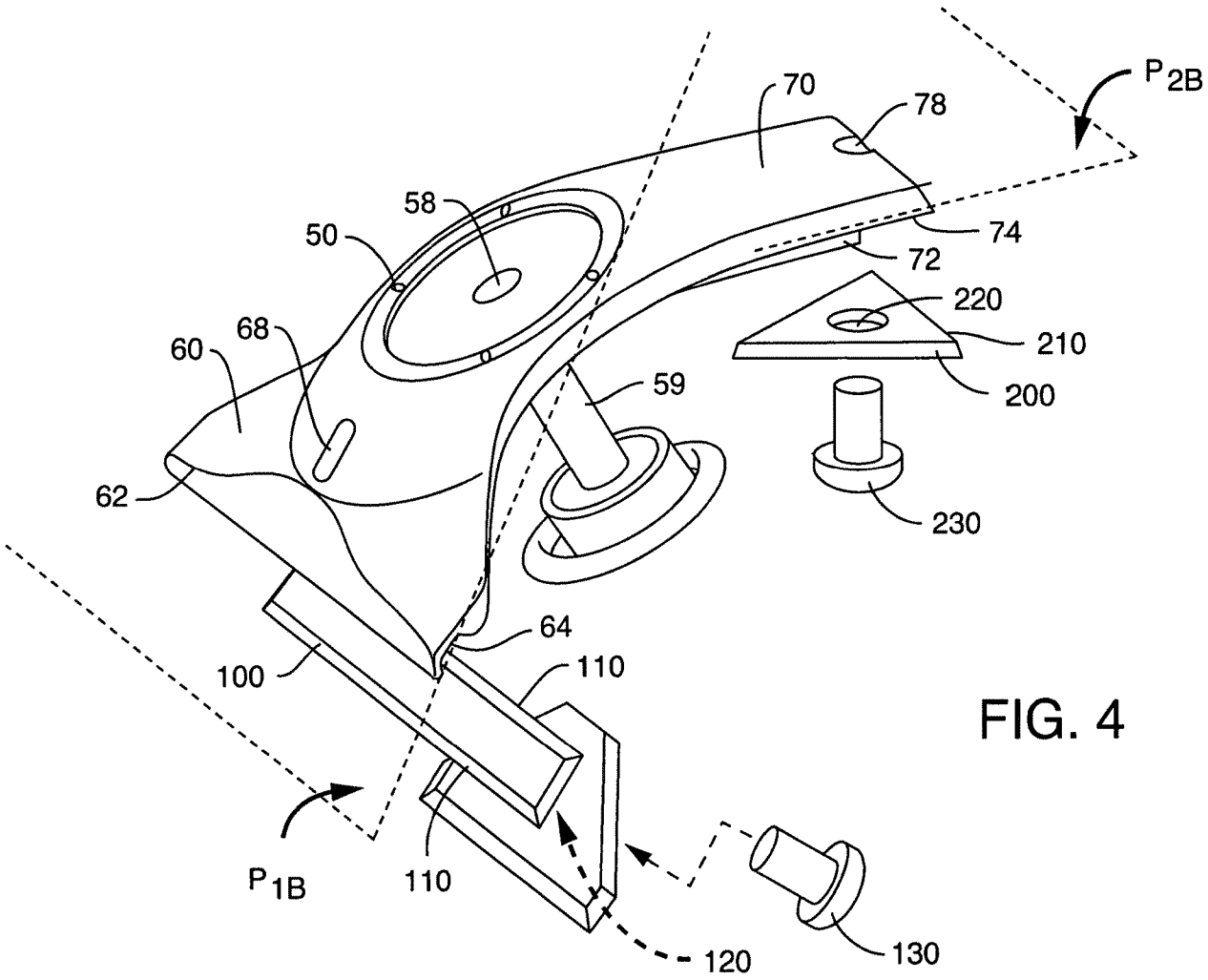
FIG. 4 shows an exploded view of a blade-retaining head such as that shown in FIGS. 1-3.

With continued reference to FIG. 1, and additional reference to FIGS. 2, 3 and 4, a blade-retaining head 50 is connected to the distal end 28 for pivotal movement, relative to the handle 20, about a head-rotation axis $A_{HR}$. The blade-retaining head 50 has first and second ends 60 and 70 situated on opposite sides of the head-rotation axis $A_{HR}$ from one another. In conjunction with FIG. 4, in which an exploded view of the blade-retaining head 50 is shown in isolation from the handle 20, it can be seen that the first end 60 of the head 50 includes a first-blade mount 62 with a first blade-supporting surface 64 defining a first blade plane $P_{1B}$ along which a first blade 100 extends when supported thereby. Correspondingly, the second end 70 of the head 50 includes a second-blade mount 72 with a second blade-supporting surface 74 defining a second-blade plane $P_{2B}$ along which a second blade 200 extends when supported thereby. In alternative embodiments, the first and second ends 60 and 70 of the head 50 and, more particularly, the first and second blade-supporting surfaces 64 and 74 are configured for the removable retention of, respectively, first and second scraping blades 100 and 200 in a manner to be illustratively described later in the present description.

Referring still to FIGS. 1-3, with first and second scraping blades 100 and 200 retained by the blade-retaining head 50, the blade-retaining head 50 is rotatable about the head-rotation axis $A_{HR}$ between a first angular position in which the first scraping blade 100 is in a deployed attitude and the second scraping blade 200 is in a non-deployed (or "storage") attitude in which the second scraping blade 200 is at least partially shrouded beneath the handle lower surface 24 and a second angular position in which the second scraping blade 200 is in a deployed attitude and the first scraping blade 100 is in a non-deployed attitude in which the first scraping blade 100 is at least partially shrouded beneath the handle lower surface 24. FIGS. 1, 2 and 3 represent different stages in the angular positioning of the blade-retaining head 50. More specifically, FIG. 1 depicts the blade-retaining head 50 in a first angular position in which the first scraping blade 100 is deployed and the second scraping blade 200 is shrouded or stored. FIG. 2 shows the blade-retaining head 50 in a transitional position in which, as indicated by the arcuate "motion arrow," it is being rotated from the first angular position toward the second angular position. FIG. 3 illustrates the blade-retaining head 50 in the second angular position in which the second scraping blade 200 is deployed and the first scraping blade 100 is shrouded or stored.

In various embodiments, such as the illustrative embodiment of FIGS. 1-3, a portion of the distal end 28 of the handle 20 is laterally flared in order to define a blade shroud 30 which, in the particular embodiment of FIGS. 1-3, resembles the "hood" of a cobra. Irrespective of the precise contour of blade shroud 30 in any particular version, however, the blade shroud 30 is generally configured such that, when each of the first and second scraping blades 100 and 200 is in its non-deployed attitude, the scraping edge 110 or 210 of that non-deployed blade is entirely shrouded by the blade shroud 30 as viewed from above the handle upper surface 22. While neither of FIGS. 1 and 3 shows the dual-bladed scraper 10 from directly above the handle upper surface 22, it can nevertheless be readily gleaned from these two views that each of the first and second blades 100 and 200 depicted would be shrouded as described when it is in the non-deployed attitude. Accordingly, for the sake of brevity, views from directly above the handle upper surface 22 are omitted.

Returning to the detail/exploded view of FIG. 4, the blade-retaining head 50 of various embodiments includes first and second blade-supporting surfaces 64 and 74 which define first and second blade planes $P_{1B}$ and $P_{2B}$ that are mutually non-coplanar and non-parallel. More specifically, the first and second blade planes $P_{1B}$ and $P_{2B}$ are pitched such that they mutually diverge downwardly away from the distal end 28 of the handle 20 to which the blade-retaining head 50 is rotatably mounted. It will also be appreciated, particularly with reference to FIGS. 2 and 3, that the blade planes $P_{1B}$ and $P_{2B}$ mutually diverge away from the head-rotation axis $A_{HR}$. In the illustrative embodiment of FIGS. 1-4, the blade-retaining head 50 is of a generally arcuate configuration, thereby facilitating the divergent blade-plane pitch while being fabricated from relatively little material.

As indicated in the background section of the present specification, it is frequently desirable to have at least two different types of scraping blades at one's disposal on a job site, and this is, in fact, one of the advantages of various aspects of the present invention. Accordingly, in the version depicted in the drawings, the first and second scraping blades 100 and 200 of dual-bladed scraper 10 are of disparate configurations. With reference to any of FIGS. 2, 3 and 4, the first scraping blade 100 is of generally rectangular configuration and includes at least one first-blade scraping edge 110 along one or both of its longer sides. It will be readily appreciated that the first scraping blade 100 could include two opposed first-blade scraping edges 110, one along each of its longer sides, such that, when one of the first-blade scraping edges 110 wears out, the first scraping blade 100 can be reversed and reseated within the first-blade mount 62 so that the opposite first-blade scraping edge 110 is the "active" edge.

The second scraping blade 200 of the illustrative embodiment depicted is of generally triangular configuration and also includes at least one second-blade scraping edge 210. In some versions, the second scraping blade 200 is generally configured as an equilateral triangular and includes a second-blade scraping edge 210 along each of its three sides. In a manner similar to that associated with the first scraping blade 100, the inclusion of—in this case—three second-blade scraping edges 210 facilitates reseating of a second scraping blade 200 when one of its second-blade scraping edges 210 wears so that another of its second-blade scraping edges 210 is designated as the "active" edge.

When each of the first and second scraping blades 100 and 200 is alternatively in a deployed attitude, the "active" scraping edge thereof (i.e., first-blade or second-blade scraping edge 110 or 210) is in a transverse orientation relative to handle axis $A_H$. The broader first-blade scraping edge 110 is conducive to the scraping of relatively large planar work surfaces, while the narrower configuration of the second-blade scraping edge 210 is conducive to finer detail scraping within in openings and crevices on a work surface, for example.

Although the particular manner in which the first and second scraping blades 100 and 200 are removably secured to the blade-retaining head 50 is of no particular relevance to the novel aspects of various embodiments, in the embodiment of FIGS. 1-4, threaded fasteners (e.g., screws) are used. More specifically, in the non-limiting illustrative configurations depicted, the second scraping blade 200 includes a second-blade aperture 220 through which a second-blade fastener 230 is fed for threadable securement in a threaded second-mount aperture 78 defined in the second-blade mount 72. In the case of the first scraping blade 100, a first-blade bearing plate 115 includes a bearing-plate aperture 120 through which a first-blade fastener 130 is fed for threadable securement in a threaded first-mount aperture 68 defined in the first-blade mount 62. When secured, the first scraping blade 100 is "clamped" between the first blade-supporting surface 64 and the first-blade bearing plate 115 as indicated in FIGS. 2-4.

Additionally, while the manner in which the blade-retaining head 50 is secured to the distal end 28 of the handle 20 is of, at most, secondary relevance, in the embodiment(s) depicted, the blade-retaining head 50 has defined therethrough a head aperture 58 through which a threaded head fastener 59 is fed for threadable securement within a threaded distal-end aperture 29 defined in the distal end 28 of the handle. It will be appreciated that the blade-retaining head 50 can be rotated about the head-rotation axis $A_{HR}$ by loosening the head fastener 59 and, conversely, set in either of the first and second angular positions previously described by tightening the head fastener 59. It will also be readily appreciated that in embodiments of the general type depicted, at least one of the head fastener 59 and the distal-end aperture 29 defines the head-rotation axis $A_{HR}$.

While grasping of the grip portion 27 by a user's first hand facilitates the application of a scraping force $F_{SA}$ primarily along a work surface (not shown) being scraped, effective scraping typically also requires the application of a scraping force into (i.e., perpendicular or "normal" to) the work surface. The application of adequate forces along and perpendicular to the work surface can be difficult to achieve with one hand, a challenge that is exacerbated proportionally with increased distance/length between the grip portion 27 and the deployed first or second scraping blade 100 or 200. Accordingly, in order to facilitate the application of a normal scraping force $F_{SN}$ to a work surface being scraped, various embodiments include a knob 90 configured for gripping by a user's second hand (i.e., the hand not gripping grip portion 27). As shown in FIGS. 1-3, the knob 90 is attached to the handle 20 and extends upwardly from the handle upper surface 22. It will be readily appreciated that the usefulness of the knob 90 is optimized by locating it along the handle 20 is in the vicinity of the blade-retaining head 50.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A dual-bladed scraper comprising:

an elongated handle having handle upper and lower surfaces extending along a longitudinal handle axis between a proximal end including a grip portion configured for gripping by a user's hand and a distal end extending forwardly of the proximal end; and a blade-retaining head mounted to the distal end for pivotal movement, relative to the handle, about a head-rotation axis and having opposed first and second ends mutually situated on opposite sides of the head-rotation axis and being configured for the removable retention of, respectively, first and second scraping blades each of which first and second scraping blades is securable to the blade-retaining head independently of the other scraping blade and has at least one scraping edge, the blade-retaining head being pivotable about the head-rotation axis between a first angular position in which, when the first and second scraping blades are secured to the blade-retaining head, the first blade is in a deployed attitude and the second blade is in a non-deployed attitude in which the second blade is at least partially shrouded beneath the handle lower surface and a second angular position in which the second blade is in a deployed attitude and the first blade is in a non-deployed attitude in which the first blade is at least partially shrouded beneath the handle lower surface, wherein the first and second scraping blades are of disparate geometrical shapes.

2. The scraper of claim 1 wherein at least a portion of the distal end of the handle is laterally flared relative to the grip portion to define a blade shroud configured such that, when each of first and second scraping blades retained by, respectively, the first and second ends is alternatively in the non-deployed attitude, the at least one scraping edge of that non-deployed blade is entirely shrouded by the blade shroud as viewed from above the handle upper surface.

3. The scraper of claim 2 wherein the first and second ends of the blade-retaining head comprise, respectively, first and second blade mounts defining, respectively, first and second blade planes that are mutually non-coplanar and non-parallel.

4. The scraper of claim 1 wherein the first and second ends of the blade-retaining head comprise, respectively, first and second blade mounts defining, respectively, first and second blade planes that are mutually non-coplanar and non-parallel.

5. A dual-bladed scraper comprising:

an elongated handle having handle upper and lower surfaces extending along a longitudinal handle axis between a proximal end including a grip portion configured for gripping by a first hand of a user and a distal end extending forwardly of the proximal end and grip portion; and a blade-retaining head mounted to the distal end for pivotal movement, relative to the handle, about a head-rotation axis and having opposed first and second ends mutually situated on opposite sides of the head-rotation axis and including, respectively, first-blade and second-blade mounts independently and removably retaining, respectively, a first scraping blade having a first-blade scraping edge and second scraping blade, separate from the first scraping blade, and having a second-blade scraping edge, the blade-retaining head being pivotable about the head-rotation axis between a first angular position in which the first blade is in a deployed attitude and the second blade is in a non-deployed attitude in which the second-blade scraping edge is at least partially shrouded beneath the handle lower surface and a second angular position in which the second blade is in a deployed attitude and the first blade is in a non-deployed attitude in which the first-blade scraping edge is at least partially shrouded beneath the handle lower surface, wherein the first and second scraping blades are of mutually disparate geometrical shapes.

6. The scraper of claim 5 wherein a portion of the distal end of the handle is laterally flared in order to define a blade shroud configured such that, when each of the first and second scraping blades is in the non-deployed attitude, the entire scraping edge of that non-deployed scraping blade is shrouded by the blade shroud as viewed from above the handle upper surface.

7. The scraper of claim 6 wherein the first-blade and second-blade mounts include, respectively, first and second blade-supporting surfaces that define, respectively, first and second blade planes that are mutually non-coplanar and non-parallel.

8. The scraper of claim 5 wherein the first-blade and second-blade mounts include, respectively, first and second blade-supporting surfaces that define, respectively, first and second blade planes that are mutually non-coplanar and non-parallel.

9. The scraper of claim 8 wherein the first and second blade planes are pitched such that they mutually diverge downwardly away from the distal end of the handle and the head rotation axis.

10. The scraper of claim 9 wherein the blade-retaining head is of generally arcuate configuration.

11. The scraper of claim 8 wherein a portion of the distal end of the handle is laterally flared in order to define a blade shroud configured such that, when each of the first and second scraping blades is in the non-deployed attitude, the entire scraping edge of that non-deployed scraping blade is shrouded by the blade shroud as viewed from above the handle upper surface.

12. The scraper of claim 11 wherein the first and second blade planes are pitched such that they mutually diverge downwardly away from the distal end of the handle and the head rotation axis.

13. The scraper of claim 12 wherein the blade-retaining head is of generally arcuate configuration.

14. The scraper of claim 5 wherein the scraping edge of a scraping blade in a deployed attitude extends transversely to the longitudinal handle axis.

15. A dual-bladed scraper comprising:

a handle having handle upper and lower surfaces; and a blade-retaining head mounted to the handle for pivotal movement between first and second angular positions about a head-rotation axis and having opposed first and second ends situated on mutually opposite sides of the head-rotation axis;

a first scraping blade retained by the first end of the blade-retaining head and having a first-blade scraping edge; and a second scraping blade retained by the second end of the blade-retaining head and having a second-blade scraping edge, wherein (i) the first angular position is such the first blade is in a deployed attitude and the second-blade scraping edge is shrouded beneath the handle in a non-deployed attitude;

(ii) the second angular position is such that the second blade is in a deployed attitude and the first-blade scraping edge is shrouded beneath the handle in a non-deployed attitude; and (iii) the first and second scraping blades are mutually separate and independently securable to the blade-retaining head; and (iv) the first and second scraping blades are of mutually disparate geometrical shapes.

* * * * *